United States Patent [19]

Kawamura et al.

[11] 4,323,444

[45] Apr. 6, 1982

[54] FILTER PRESS-TYPE ELECTROLYTIC CELL

[75] Inventors: Chikayuki Kawamura; Toshiro Isoya; Kazunori Yamataka, all of Nobeoka, Japan

[73] Assignee: Asahi Kasei Kogyo Kabushiki Kaisha, Osaka, Japan

[21] Appl. No.: 173,139

[22] Filed: Jul. 28, 1980

[30] Foreign Application Priority Data

Jul. 31, 1979 [JP] Japan ..... 54/97817

[51] Int. Cl.[3] ..... C25B 9/00; C25B 11/10; C25B 15/08

[52] U.S. Cl. ..... 204/269; 204/275; 204/290 F

[58] Field of Search ..... 204/253-258, 204/263-266, 267-270, 275-278, 290 F

[56] References Cited

U.S. PATENT DOCUMENTS

| | | | |
|---|---|---|---|
| 1,541,947 | 6/1925 | Hartman et al. | 204/269 X |
| 1,674,364 | 6/1928 | Hartman | 204/269 |
| 3,119,760 | 1/1964 | Foreman et al. | 204/269 |
| 4,124,478 | 11/1978 | Tsien et al. | 204/255 |
| 4,252,628 | 2/1981 | Boulton et al. | 204/257 |

*Primary Examiner*—Delbert E. Gantz
*Assistant Examiner*—Donald R. Valentine
*Attorney, Agent, or Firm*—Armstrong, Nikaido, Marmelstein & Kubovcik

[57] ABSTRACT

In a filter press-type electrolytic cell comprising a group of electrode plates arranged in parallel in face-to-face positions through insulators, a pair of metallic press heads for tightening the group of the electrode plates from both ends of the group, the press heads being provided at both ends of the group of the electrode plates, peripheral edges of the electrode plates being sealed by gaskets, supply and discharge of an electrolytic solution to and from spaces between the electrode plates being conducted through an inflow hole and an outflow hole bored on the individual electrode plates, an inlet and an outlet for the electrolytic solution are provided on only one of the press heads at both ends, the inlet is connected to a passage formed by the inflow holes of the individual electrode plates, the outlet is connected to a passage formed by the outflow holes of the individual electrode plates, an insulating plate of large thickness made from a non-electroconductive material is placed between the press head provided with the inlet and the outlet and the nearest electrode plate to the press head, and an inflow hole and an outflow hole are bored on the insulating plate and communicated with the inflow holes and the outflow holes of the individual electrode plates, respectively, thereby allowing the insulating plate to prevent the press head and the nearest electrode plate from direct facing. Galvanic corrosion of the press heads can be prevented.

11 Claims, 8 Drawing Figures

FILTER PRESS-TYPE ELECTROLYTIC CELL

This invention relates to a filter press-type electrolytic cell, and more particularly to an electrolytic cell suitable for organic electrolysis.

Generally, a filter press-type electrolytic cell comprises a group consisting of electrode plates arranged in parallel in face-to-face positions, peripheral gaskets for sealing an electrolytic solution and spacers for keeping a given distance between the electrode plates, thereby forming spaces between the electrode plates, each of the peripheral gaskets and a set of the spacers being provided between the electrode plates, and a pair of press heads for tightening the group of the electrode plates at both ends of the group of the electrode plates, where supply and discharge of the electrolytic solution to and from the spaces between the electrode plates are conducted through holes provided on the individual electrode plates. As compared with electrolytic cells of other types applicable to organic electrolysis, for example, an electrolytic cell using a pair of vibrating electrodes or a capillary gap-type electrolytic cell, the electrode plates of the filter press-type electrolytic cell are so simple in structure that electrode plates with a larger available electrolytic area can be readily fabricated. Furthermore, the filter press-type electrolytic cell has less operational trouble for supplying an electrolyte solution to the electrolytic cell, that is, a system for supplying an electrolytic solution separately into the individual spaces between the electrode plates from an outside conduit for electrolytic solution, and a system of supplying an electrolytic solution from press heads to the individual spaces between the electrode plates through holes provided at the inside of each peripheral gasket between the electrode plates. However, these systems have the following disadvantages. That is, an electrolytic cell of the first system is comprised of electrodes as disclosed in Japanese Laid-open Patent Application No. 4410/72, where the electrodes are regarded as suitable for electrochemical reaction of organic material, for example, commercial, large scale practice of Kolbe reaction, but the individual electrodes are provided with an inlet and an outlet for electrolyte solution, and compartments connected to these holes are provided at the inside of the electrodes, and consequently the electrodes must inevitably have a larger thickness. That is, the electrodes have a larger weight and a complicated structure, and also there are so many joints between the electrodes and the outside conduit for electrolytic solution that much labor is required for assembling or dismantling the electrolytic cell. Furthermore, there is a risk of explosion, fire, intoxication, etc. by a liquid or gas leakage at the joints, and particularly the risk is increased when the electrolytic solution is an organic electrolytic solution.

In the case of an electrolytic cell of the second system, joints between the electrolytic cell and the outside conduit for electrolytic solution are located only at the inlet and the outlet for the electrolytic solution which are provided on the press heads, and accordingly the risk of a liquid or gas leakage is reduced and the structure of the electrode becomes simpler, but there is still a problem of galvanic corrosion of metallic press heads. That is, there is usually a difference in potential between the press heads and the electrodes, and another electric current in addition to the desired electric current between the electrodes will pass through the electrolytic solution from an electrode having a higher potential than that of a press head toward the press head, and from a press head toward an electrode having a lower potential than that of the press head, and consequently galvanic corrosion will occur at the press heads.

The present inventors have made extensive studies of overcoming the aforementioned disadvantages of the conventional filter press-type electrolytic cell, and have found, as a result of the studies, that the galvanic corrosion of the press heads can be prevented in the filter press-type electrolytic cell by supplying and discharging an electrolytic solution through one of a pair of press heads at both ends and inserting an insulating plate of specific structure between the press head and the nearest electrode plate to the press head.

The present invention is based on that finding, and an object of the present invention is to provide an electrolytic cell of simple structure and easy handling, suitable for organic electrochemical reaction and particularly suitable for commercial scale electrolysis of an electrolytic solution having a relatively small specific electroconductance.

That is, in the present invention, the aforementioned object can be attained by using a filter press-type electrolytic cell which comprises a group consisting of electrode plates arranged in parallel in face-to-face positions through insulators, a pair of metallic press heads for tightening the group of the electrode plates from both ends of the group, the press heads being provided at both ends of the group of the electrode plates, peripheral edges of the electrode plates being sealed by gaskets, supply and discharge of an electrolytic solution to and from spaces between the electrode plates being conducted through an inflow hole and an outflow hole bored on the individual electrode plates, characterized in that at least one inlet and at least one outlet for the electrolytic solution to passages for supplying and discharging the electrolytic solution to and from the spaces between the electrode plates are provided only at one of the pair of the press heads provided at both ends; an insulating plate having a large thickness, comprised of a non-electroconductive material is provided between the press head provided with the inlet and the outlet and the nearest electrode plate to the press head, and passages for the electrolytic solution are provided on the insulating plate, thereby preventing the press head and the nearest electrode plate from direct facing through the electrolytic solution existing between the press head and the nearest electrode plate.

One embodiment of the electrolytic cell according to the present invention will be described in detail below, referring to the accompanying drawings.

Figure 1:
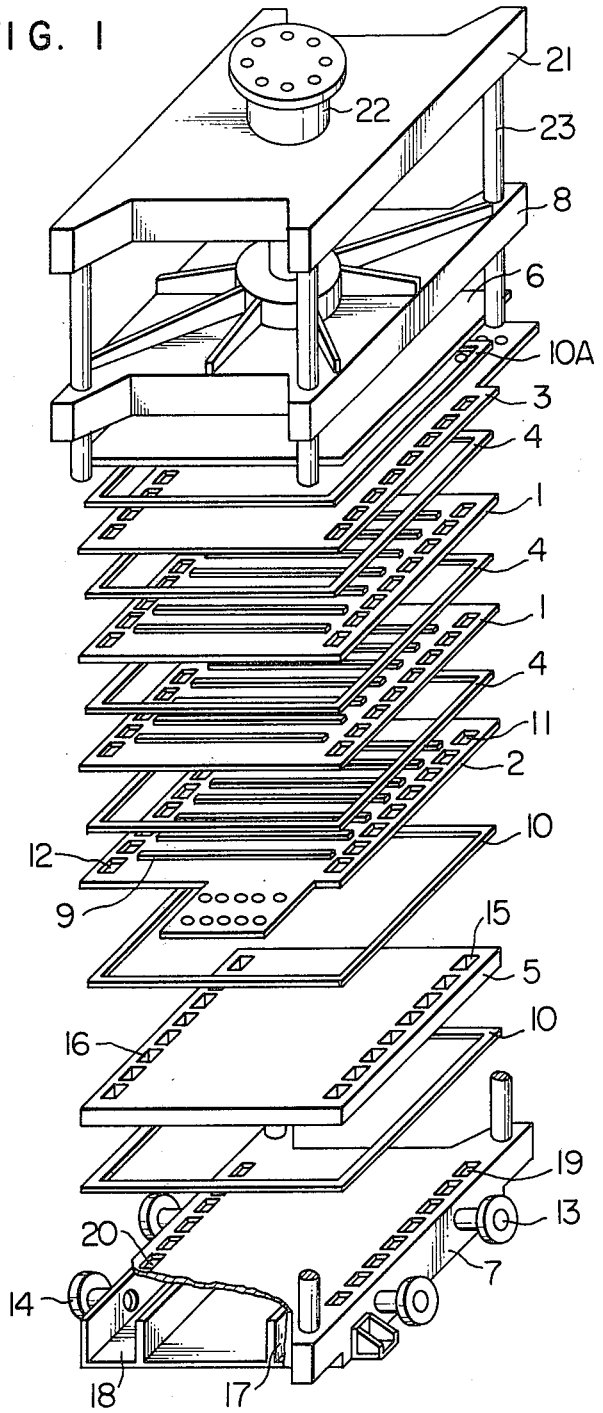
FIG. 1 is a schematic view of one embodiment of the electrolytic cell according to the present invention in a dismantled state.

As shown in FIG. 1, essential members constituting the electrolytic cell are electrode plates 1, 2 and 3, peripheral gaskets 4 for sealing the peripheral edges between the electrode plates, insulating plates 5 and 6, press heads 7 and 8 for tightening the foregoing members from both ends, when assembled, and spacers for precisely maintaining a predetermined distance between the electrode plates.

Number of electrode plates 2 depends upon the desired production scale. When the electrode plates are in small size, or an exact distance is not required between the electrode plates, the peripheral gaskets 4 can be used to play a role of the spacers 9. When the insulating plate 5 is made from a poor sealing material, gaskets 10 are provided at both sides of the insulating plate 5. Electrode plates can be positioned in either vertical or horizontal direction, but the horizontal position is preferable for the following reason. That is, in the case of horizontal position, electrode plates 1, 2 and 3 can be readily fixed at the predetermined position only by stacking the electrode plates one upon another, and thus no special supporting members are required. Even if the press heads 7 and 8 are made loose at the assembling or dismantling, the peripheral gaskets 4 and spacers 9 are never deviated from their original positions.

Shape and size of electrode plates 1, 2 and 3 can be freely selected as desired, but in view of easy handling and productivity, substantially rectangular or square shape having a side length of 0.2–2.5 m is preferable.

Electrode plates 1 and 2 have inflow holes 11 and outflow holes 12 for electrolytic solution, which are bored on the electrode plates at positions near the inner edges of the peripheral gaskets 4. The electrode plate 3 at the remotest position from the press head having the inlet 13 and the outlet 14 for electrolytic solution may have no inflow holes and outflow holes. In that case, the peripheral gasket 10A for the electrode 3 at the side of press head 8 is not required.

Preferable modes of the inflow holes 11 and the outflow holes 12 will be described below.

(a) The holes of equal shape and equal size are bored at geometrically equal positions on every electrode plates.

(b) At least one each of the inflow holes 11 and the outflow holes 12 are bored at positions as near as possible to and along the substantially entire length of the peripheral edges at the parallel sides of the substantially rectangular electrode plate.

The inflow holes 11 and outflow holes 12 bored at the geometrically equal position on the individual electrode plates constitute inflow headers and outflow headers, respectively, at positions near the inner edges of the peripheral gaskets 4, and the electrolytic solution flows cocurrently through the spaces between the electrode plates.

In electrochemical reaction, for example, in Koble reaction a large amount of gas is often generated on electrode plates, it is necessary to keep a ratio of a gas to a liquid in the spaces between the electrode plates to less than a predetermined value and also keep the cell voltage as low as and as stable as possible in order to continue the reaction.

In an electrolytic cell, where an electrolytic solution is supplied from the press head and subjected to electrochemical reaction in the first space between a first pair of the electrode plates, and then to successive electrochemical reaction in the successive spaces between successive pairs of the electrode plates by supplying the electrolytic solution to the successive spaces connected to one another in series, number of electrode plates is limited to keep the ratio of a gas to a liquid to less than a predetermined value. On the other hand, when the inflow holes 11 and the outflow holes 12 are bored on the electrode plates so that the electrolytic solution may flow cocurrently through the spaces between the electrode plates, number of electrode plates is not limited, as far as the ratio of a gas to a liquid is concerned.

When the shapes or sizes of corresponding holes on the individual pairs of electrode plates are not geometrically equal to one another, a flow resistance of the electrolytic solution through the passage formed by the holes is not only increased, but also transfer of electricity takes place between the part protruded into the passage and the other part of the adjacent electrode plate, causing to increase an electrolytic power loss or a galvanic corrosion of press heads.

Stagnation of the electrolytic solution between the electrode plates can be prevented by boring the inflow holes 11 and outflow holes 12 at positions as near as possible to the edges of parallel sides of the electrode plates, that is, at positions as near as possible to the inner edges of the peripheral gaskets 4, and also the distance between the inflow holes 11 and the outflow holes 12 can be made larger thereby. That is, the available electrode surface can be more effectively utilized. Except for relatively small electrode plates, the electrolytic solution can flow more uniformly to the full width of the passage for the electrolytic solution in the space between the electrode plates by boring of small inflow holes 11 and outflow holes 12 along substantially full length of the parallel sides of the electrode plates than boring one larger inflow hole 11 and one outflow hole 12 thereon, and also the strength of the electrode plates can be ensured thereby.

Material of electrode plates 1, 2 and 3 suitable for the desired electrochemical reaction must be selected. For example, in the case of electrolytic condensation reaction of monomethyl ester of adipic acid by anodic oxidation, which is a kind of the aforementioned Kolbe reaction, platinum, rhodium, ruthenium, iridium, etc. can be used alone or in an alloy as the anode, and usually can be used in a galvanized form. That is, titanium, tantalum, etc. can be used as a substrate material for galvanization.

A preferable cathode is a metal having a low hydrogen overvoltage, but is not restricted thereto. For example, platinum, iron, stainless steel, titanium, etc. can be used. It is particularly preferable to use stainless steel as a material of the electrode plate, which is directly connected to a negative pole of electrolysis power source, and titanium as a material for other electrode plates, one side of which is plated with platinum, and the platinum-plated surface is used as an anode, whereas the other side, that is, titanium surface, is used as a cathode. That is, the electrode plates can be used in the form of dipolar electrode plates.

In the dipolar electrode plates comprised of titanium or tantalum as an electrode material with coating of such a noble metal as platinum, rhodium, ruthenium, iridium, etc. alone or in their alloys, a coating area of the noble metal can be usually restricted only to one side of the electrode plate, and more preferably, to one side excluding the outer area than that occupied by the peripheral gasket 4 and the peripheral parts of the inflow holes 11 and the outflow holes 12. As will be obvious from Example 3, this is to suppress a tendency of an electric current to pass from the peripheral parts of the inflow holes 11 and the outflow holes 12 over the adjacent electrode plate to other electrode plates having a lower potential and/or to the press head 7, thereby reducing the electrolytic power loss and/or galvanic corrosion of the press head, and also to save use of the expensive noble metal.

The thickness of the noble metal to be coated depends upon the reliability and consumption rate of coating film. For example, when the electrode plate is coated with platinum by galvanizing, many pinholes develop in the case of the thickness of less than 1$\mu$, whereas too large thickness is not preferable from the viewpoint of uniformity of the coating film and economy. Appropriate thickness is 2–10$\mu$.

The thickness of dipolar electrode plate is not particularly limited, but the mechanical strength becomes lower in the case of the thickness of less than 1 mm, and there can be a risk of deformation during the handling. Too large a thickness increases not only the material cost, but also the weight, giving an inconvenience to the handling. Thus, the thickness is practically 1.5–5 mm.

Peripheral gaskets 4 are provided between the electrode plate and the adjacent electrode plate to be placed in a face-to-face position to seal the peripheral edges of the electrode plates. The gasket can be made from a material having a high volume resistivity, a good sealability and a good corrosion resistance to an electrolytic solution to be handled. For example, the material can be natural rubber, synthetic rubber and soft plastics.

Spacers 9 are made from a material having appropriate strength, dimensional stability and insulating property under the conditions of handling an electrolytic solution at the desired temperature, and can be made from, for example, polyolefin, polyamide or polyester admixed with an inorganic filler. It is preferable to use spacers in such a form as to give a smaller flow resistance on the electrode plates without reducing the available electrolytic area of the electrode plates, for example, spacers in a band form, placed in parallel to the flow of an electrolytic solution as shown by 9 in FIG. 1.

Tightening mechanism of the press heads can be the ordinary one. For example, an oil-hydraulic mechanism can be used.

In the embodiment of horizontally positioned press heads shown in FIG. 1, the stationary press head 7 is fixed to the floor of a building, whereas the movable press head 8 is free to vertically move along guide bars 23 by an oil-hydraulic cylinder 22 fixed to an upper head 21.

As a material for the press heads 7 and 8, a relatively cheap material having a good mechanical strength can be used. For example, the movable press head 8 can be made from carbon steel, and the stationary press head 7 can be made from carbon steel or stainless steel, depending upon the corrosiveness of an electrolytic solution.

The inlet 13 and outlet 14 for an electrolytic solution to the electrolytic cell, which are connected to a supply conduit and a discharge conduit for the electrolytic solution, respectively, provided outside the electrolytic cell, are provided at only one of the press heads, preferably at the stationary press head 7.

In the case of an electrolytic cell in which the inlet is provided at one press head, and the outlet at another press heads, a highly electroconductive circuit will be formed between both press heads through the outside conduits for the electrolytic solution, connected to the press heads or through the floor of the building, even though an insulating plate, which will be described later, is provided between the electrode plate and the press head, and thus the galvanic corrosion of the press heads cannot be effectively prevented.

When the inlet 13 and the outlet 14 for the electrolytic solution are provided at the movable press head 8, the outside conduits for the electrolytic solution must be disengaged from the joint parts of the movable press head in the case of removing electrode plates from the electrolytic cell. This is a great inconvenience.

Corresponding number of the inlet 13 and the outlet 14 can be bored on the press head, so that they each can communicate with the corresponding inflow holes 15 and the corresponding outflow holes 16 of the insulating plate, which will be described later, but more preferable mode of the inlet 13 and the outlet 14 for uniformly supplying and discharging the electrolytic solution to and from the spaces between the electrode plates will be as follows:

At the inside of the stationary press head 7, there are provided an inflow chamber 17 for the electrolytic solution, connected to the inlet 13 for the electrolytic solution, and an outflow chamber 18 for the electrolytic solution, connected to the outlet 14, to an extent corresponding to the width of the passage for the electrolytic solution between the electrode plates.

The insulating plate 5 is inserted between the stationary press head 7 and the electrode plate 2 nearest to the stationary press head 7, and is provided with inflow holes 15 and outflow holes 16, corresponding to the inflow holes 11 and the outflow holes 12 of the electrode plate 2, respectively.

The stationary press head 7 is provided, at the insulating plate-facing side, with inflow holes 19 corresponding to the inflow holes 15 of the insulating plate and being connected to the inflow chamber 17 of the press head 7, and outflow holes 20 corresponding to the outflow holes 16 of the insulating plate and being connected to the outflow chamber 18 of the press head 7. That is, the electrolytic solution is led to the inflow chamber 17 from a conduit outside the electrolytic cell through inlet 13 of the press head 7, extended to a full width corresponding to that of the passage between the electrode plates, then charged into the inside headers formed by the inflow holes 15 and 11 of the insulating plate and the electrode plates through the inflow holes 19, and uniformly distributed into the spaces between the electrode plates. On the other hand, the electrolytic solution, which has been subjected to reaction on the surfaces of the electrode plates, is likewise returned to a conduit outside the electrolytic cell through the inside headers formed by the outflow holes 12 and 16 of the electrode plates 1 and 2, and the insulating plate 5 and the outflow holes 20, the outflow chamber 18 and the outlet of the stationary press head 7.

In the press head 7 of such a structure as described above, one inlet 13 and one outlet 14 are usually satisfactory, but the inlets and the outlets can be used particularly when a large volume of the electrolytic solution must be handled. In any case, the individual electrode plates have no joint parts with the outside, and thus a risk of explosion, fire, intoxication, etc. due to a liquid or gas leakage can be reduced, and also the electrolytic solution can be uniformly supplied to the full width of the passage for the electrolytic solution between the electrode plates.

The press head 8 having no inlet and no outlet for the electrolytic solution functionally has no necessity for contact with the electrolytic solution, and thus must be free from the part in direct contact with the nearest electrode plate 3 to the press head. Accordingly, an insulating plate 6 made from the nonelectroconductive material is inserted between the press head 8 and the nearest electrode plate. The insulating plate 6 made from, for example, rubber or plastic can be used.

On the other hand, the press head having the inlet 13 and the outlet 14 for the electrolytic solution is electrically connected to the electrode plates 1, 2 and 3 through the electrolytic solution, and thus the galvanic corrosion of the press head cannot be prevented by the ordinary insulation of preventing direct contact of the press head with the electrode plates.

In the electrolytic cell according to the present invention, the insulating plate 5 devised not only to prevent physical direct contact therebetween, but also to suppress the passage of electric current to the press head through the electrolytic solution is inserted between the press head 7 and the electrode plate 2.

To suppress the electric current passage between the press head 7 and the electrode plates 1, 2 and 3, it seems better to increase an electric resistance of the electrolytic solution near the peripheral edges of the individual holes forming the current circuit. The specific conductance of an electrolytic solution is of proper and unchangeable nature, but in the case of a small specific electroconductance of, for example, an organic electrolytic solution, the degree of galvanic corrosion of a press head closely depends upon the thickness of an insulating plate, relationships in hole sizes between the corresponding insulating plate and press head as well as the electrode plates, hole shape of the insulating plate, etc. as is obvious from Table 1 of Example 2.

The insulating plate according to the present invention has a large thickness and is made from a nonelectroconductive material and is provided with inflow holes 15 and outflow holes 16 for the electrolytic solution so that the press head 7 and the electrode plate 2 may not face directly each other through the electrolytic solution existing therebetween. That is, the inflow holes 15 and the outflow holes 16 of the insulating plate 5 are bored thereon so that the peripheral edges of the corresponding holes of the electrode plates 2 or the press head 7, preferably the peripheral edges of the corresponding holes of both electrode plates and the press head may not be protruded inwardly from the peripheral edges of the holes of the insulating plate 5, unless the holes of the insulating plate 5 are bent at the inside of the insulating plate 5.

In the case of such an insulating plate, the necessary minimum thickness of the insulating plate must be experimentally determined according to the specific electroconductance of an electrolytic solution, operating current density and limit to allowable galvanic corrosion, and cannot be generalized. However, in the ordinary organic electrolytic reaction, an insulating plate having a thickness of 4–60 mm is used. The thickness of 10–40 mm is particularly preferable in the strength and easy handling. Below the thickness of 3 mm, the effect of preventing a galvanic corrosion is lowered, whereas, above the thickness of 60 mm, the weight is increased, and an inconvenience in handling is more dominant than the effect of preventing the galvanic corrosion. Insulating plates having a small thickness, for example, a thickness of less than 4 mm, can be used by stacking them one upon another to the total thickness of 4–60 mm.

Figure 6:
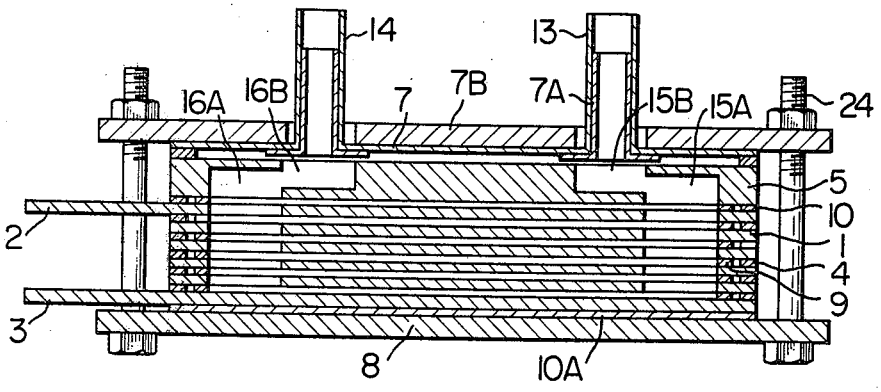
FIG. 6 is a cross-sectional view of an electrolytic cell in an assembled state which is used in Example 2C.
Figure 7:
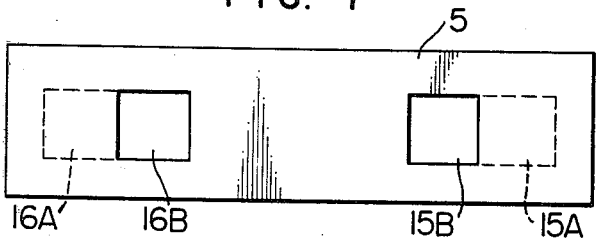
FIG. 7 is a plan view of an insulating plate used in Example 2C.
Figure 8:
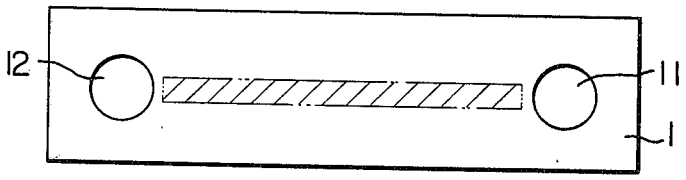
FIG. 8 is a plan view showing a plated area on the electrode plate used in Example 3.

Furthermore, the galvanic corrosion of the press head can be effectively prevented according to another example of the insulating plate as given below. That is, when the galvanic corrosion of the press head 7 is expected to increase on account of a high specific electroconductance of an electrolytic solution, an insulating plate 5, whose inflow holes 15 and outflow holes 16 are bent in cross-section so as not to make aligned communication of openings 15A and 16A at the electrode-facing side of the insulating plate with openings 15B and 16B at the press head-facing side thereof, as shown in FIG. 6, can be used in place of increasing the thickness of the insulating plate. In such an insulating plate, an electric current flowing toward the press head from an electrode plate having a higher potential than that of the press head and an electric current flowing from the press head toward an electrode plate having a lower potential than that of the press head are to pass through the bent holes in the insulating plate, but the electrical passage is considerably constricted and a distance for the electric current flow is prolonged. Thus, it seems that a remarkable effect of preventing the galvanic corrosion can be attained thereby.

As the material for the insulating plate, those having a good resistance to an electrolytic solution, a good insulating property, and a compression strength good enough to withstand the compression pressure can be used. For example, natural rubber, synthetic rubber, polyolefin, polyamide or polyester, or any of those further containing an inorganic filler can be used.

According to the present invention, a galvanic corrosion of press heads in a filter press-type electrolytic cell can be considerably reduced by providing an inlet and an outlet for an electrolytic solution at only one of a pair of press heads and inserting an insulating plate having a large thickness of special structure between the press head and the nearest electrode plate to the press head, as described in the foregoing. As a result, no inlets and outlets for the electrolytic solution are required on the individual electrode plates, and accordingly the structure of the electrode plates can be simplified, and at the same time assembling and dismantling of the electrode plates can be easily carried out because of less joints with outside headers, and a risk of explosion, fire, intoxication, etc. due to a liquid or gas leakage can be reduced. Since the effect of the insulating plate is more remarkable in the case of an electrolytic solution having a lower specific electroconductance, the present electrolytic cell is particularly suitable for organic electrolysis reaction, for example, for a commercial scale practice of Kolbe reaction.

The present electrolytic cell will be more specifically described below to show its effects by referring to examples of synthesizing dimethyl ester of sebacic acid by electrolytic condensation reaction of monomethyl ester of adipic acid, but the present invention will not be restricted to these examples.

EXAMPLE 1

Dimethyl ester of sebacic acid was synthesized from monomethyl ester of adipic acid by electrochemical reaction in an electrolytic cell as shown in FIG. 1.

Electrode plates 1, 2 and 3 were made from titanium, and had an outer dimension of 1,000 mm×1,000 mm and a thickness of 3 mm, and the electrode plates 2 and 3 each had an extended terminal, the extended terminal of the electrode plate 2 being connected to a positive pole of an electrolysis power source and that of the electrode plate 3 to a negative pole thereof.

On the electrode plates 1 and 2, a row of 8 inflow holes 11 and a row of 8 outflow holes 12, each having a dimension of 105 mm×40 mm, were bored in parallel at a distance of 850 mm between the rows, and the area between the row of the inflow holes 11 and the row of the outflow holes 12 of 940 mm×850 mm were platinum-plated to a coating thickners of 3.0μ only on one side of the electrode plates. The inflow holes and the outflow holes of the electrode plate 3 as shown in FIG. 1 were not required in the present example and thus the electrode plate 3 was free from any of the inflow holes and outflow holes for an electrolytic solution and also was not platinum-plated in the present example. Thus, no gasket 10A as shown in FIG. 1 was used in the present example. Three electrode plates 1 were placed in parallel between the electrode plates 2 and the electrode plate 3, and 15 spacers 9 being made from polypropylene containing talc, each having a dimension of 1.0 mm thick, 9 mm wide and 840 mm long were placed at pitches of 58 mm between the electrode plates in the present example, though 7 spacers are used in the electrolytic cells as shown in FIG. 1. Four gaskets made from natural rubber, each having a dimension of 2.5 mm thick and 8 mm wide, were placed in grooves, 1 mm deep and 13 mm wide, provided around the peripheral edges at both sides of the individual electrode plate. An insulating plate made from polypropylene containing talc and having a thickness of 40 mm and inflow holes 15 and outflow holes 16 for electrolytic solution of the same dimension at the same positions as on the electrode plate 2 was placed between the press head 7 and the electrode plate 2, and the peripheral edges at the both sides of the insulating plate were sealed by gaskets 10 made from natural rubber and having a dimension of 2.5 mm thick and 8 mm wide. The press head 7 was made from stainless steel and had an outer dimension of 1,000 mm×1,000 mm×100 mm, and horizontally placed on the floor of a building. The press head had two inlets 13 and two outlets 14 for electrolytic solution at a pair of parallel sides thereof, nominal size of the inlets and the outlets being 3-inch, an inflow chamber 17 and an outflow chamber 18 at the inside of the press head, each chamber having a dimension of 980 mm×80 mm×50 mm, and 8 inflow holes 19 and 8 outflow holes 20 on the insulating plate-facing side thereof, the sizes of the inflow holes and the outflow holes being equal to those of the insulating plate, that is, 105 mm×40 mm.

The movable press head 8 with no inlet and no outlet for electrolytic solution was made from carbon steel, and a natural rubber plate having a thickness of 3 mm and no holes was placed between the movable press head 8 and the electrode plate 3.

The foregoing members were assembled in the manner as shown in FIG. 1 and the press heads at both ends were tightened oil-hydraulically. An available electrolytic area of one electrode plate of the electrolytic cell thus assembled was 64.4 $dm^2$ and a total available electrolytic area of all the electrode plates was 273.6 $dm^2$.

Figure 2:
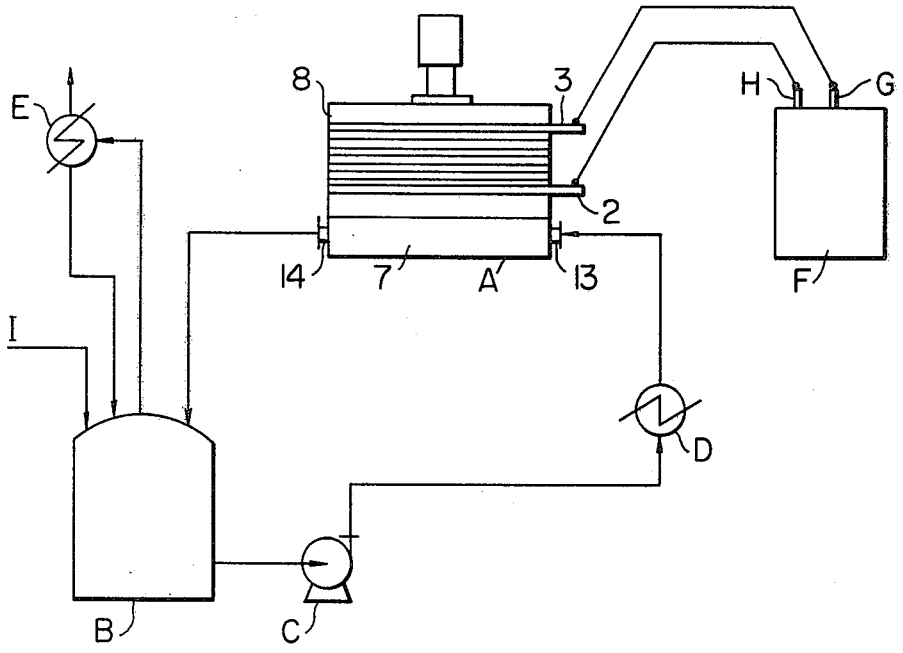
FIG. 2 is a flow diagram showing one embodiment of an apparatus for electrolysis using the electrolytic cell according to the present invention.

An apparatus for electrolysis was comprised of an electrolytic cell A, a tank B, a pump C, a cooler D, a condenser E, and a power source F, as shown in FIG. 2. Electrode plates 2 and 3 were connected to a positive pole H and a negative pole G of the electrolysis power source F, respectively.

As the electrolytic solution, a methanol solution was used, which contained, at the start of electrolysis, 35.7% by weight of monomethyl ester of adipic acid, 5.0% by weight of potassium salt of monomethyl ester of adipic acid, and 1.8% by weight of water. 500 kg of the electrolytic solution of the abovementioned composition was charged into the tank B from a supply line I, and the electrolytic solution was circulated from the tank B to the cooler D, the electrolytic cell A and again to the tank B by adjusting a discharge rate of the pump C to 23.2 $m^3$/hr to make a flow velocity of the electrolytic solution through the spaces between the electrode plates 2 m/sec, and electrolysis was carried out for 13.7 hours while setting the electrolysis power source F to produce a current density of 10.3 A/$dm^2$ and controlling the temperature of the cooler D to keep the temperature of the electrolytic solution in the tank B at 55° C. Carbon dioxide gas and hydrogen gas formed in the electrolytic cell were led to the tank B together with the returned electrolytic solution, and separated from the electrolytic solution therein. The separated gas was vented to the atmosphere after the accompanying methanol vapor was separated from the gas by condensation through the condenser E. Inlet and outlet pressure of the electrolytic cell were 1.2–1.4 kg/$cm^2$ and 0.1–0.2 kg/$cm^2$, respectively, and the voltage per electrode plate was varied from 7.5 V to 5.7 V.

The amount of the electrolytic solution after the end of the electrolysis was 455 kg, and the concentrations of the respective components in the solution were measured by gas chromatography. It was found that the resulting solution contained 23.0% by weight of dimethyl ester of sebacic acid and 0.01% by weight of monomethyl ester of adipic acid. Current efficiency of dimethyl ester of sebacic acid was 62.2%, and material yield was 79.8%. After 6 batches of electrolysis under the same electrolysis conditions as mentioned above, the electrolytic cell was dismantled, and the press head was inspected. No galvanic corrosion was observed at all. Total quantity of the electric current used was 57,911 A/hr.

COMPARATIVE EXAMPLE 1

Three batches of electrolysis were carried out in the same manner under the same conditions in the same electrolytic cell as used in Example 1 except that a plate of natural rubber having a thickness of 3 mm and the same shape as the insulating plate as in Example 1 was placed between the electrode plate 2 and the press head 7 in place of the insulating plate having a thickness of 40 mm and no gaskets 10 were used. Total quantity of the electric current used was 28,893 A/hr. After the end of electrolysis, the electric cell was dismantled, and the press head 7 was inspected. Corrosion was clearly observed at the peripheral edges of the inflow holes 19 and the outflow holes 20 for the electrolytic solution.

EXAMPLE 2

Figure 3:
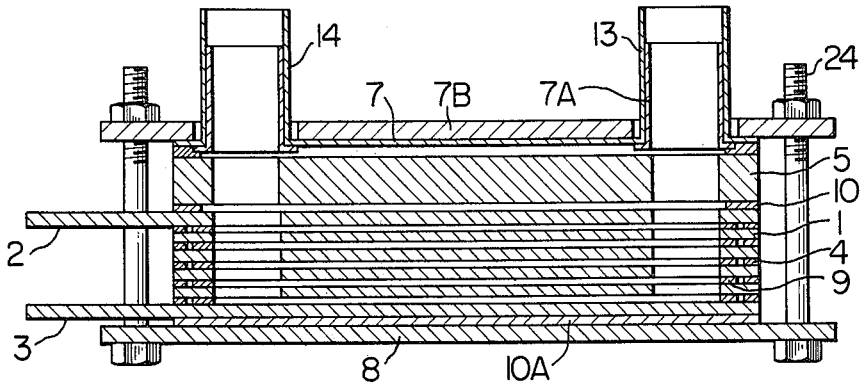
FIG. 3 is a cross-sectional view of an electrolytic cell according to the present invention, as assembled, which is used in Example 2 and Comparative Example 2.
Figure 4:
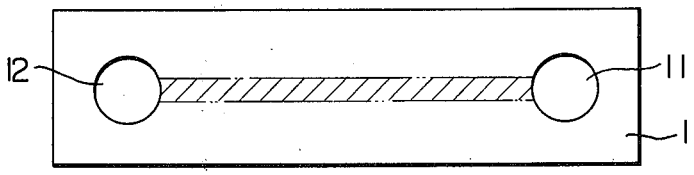
FIG. 4 is a plan view showing an electrode plate used in Example 2 and Comparative Example 2, and its plated area.
Figure 5:
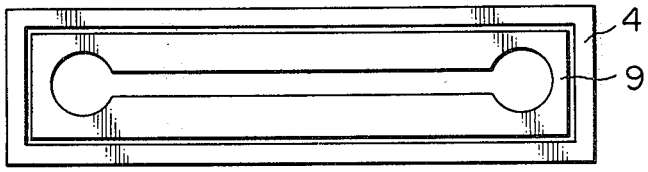
FIG. 5 is a plan view of spacer and gasket used in Examples 2 and 3 and Comparative Example 2.

An electrolytic cell as shown in FIG. 3 was used. Electrode plates were made from titanium and had an outer dimension of 300 mm×80 mm×3 mm. Electrode plates 1 and 2 each had an inflow hole 11 and an outflow hole 12 each having a diameter of 40 mm, provided at a distance of 220 m between the centers of the inflow hole and the outflow hole, as shown in FIG. 4. A hatched area of 180 mm×10 mm between the inflow hole and the outflow hole at one side of the electrodes plates, as shown in FIG. 4, and the side walls of the inflow hole 11 and the outflow hole 12 were platinum-plated to a coating thickness of 3.0μ. The electrode plate 3 had no holes and no platinum coating. The electrode plates 2 and 3 each had an extended terminal, the extended terminal of the electrode plate 2 being connected to the positive pole of a power source, and that of the electrode plate 3 to the negative pole thereof. Four electrode plates 1 were placed in parallel between the electrode plate 2 and the electrode plate 3, and spacers 9 of polypropylene having an outer dimension of 280 mm×60 mm and a thickness of 1.0 mm and an opening in a range corresponding to the hole parts and the platinum-plated area of the electrode plate, as shown in FIG. 5 and gaskets 4 of natural rubber having a thickness of 1.5 mm and a width of 10 mm around the spacers 9 were placed between the electrode plates. An insulating plate 5 of polypropylene having an outer dimension of 300 mm×80 mm and a thickness shown in Table 1 was placed between the electrode plate 2 and a press head 7. The inflow hole and outflow hole of the insulating plate were bored at the same positions with the same size as the inflow hole and the outflow hole on the electrode plate 2 in Examples 2A, 2B, and 2D, whereas in Example 2C the inflow hole and outflow hole were bent at the inside of the insulating plate as shown in FIG. 6.

Openings 15A and 16A at the electrode 2-facing side of the insulating plate and openings 15B and 16B at the press head 7-facing side of the insulating plate used in Example 2C were all in square forms having equal side length of 40 mm, and the centers of the openings 15A and 16A were in alignment with the centers of the inflow hole 11 and the outflow hole 12 of the electrode plate F, respectively, and the openings 15B and 16B were bored at positions which were located in parallel and inwards by 40 mm from the positions of the openings 15A and 16A, respectively, and all the openings had a depth of 7 mm, and the minimum cross-sectional area of the bent passages was 40 mm×4 mm.

Gaskets 10 were placed at both sides of the insulating plate 5, which were natural rubber frames having a thickness of 2.5 mm, a width of 15 mm, and an outer dimension of 300 mm×80 mm.

As materials for the press head 7, a stainless steel plate having a thickness of 3 mm was used for the part in contact with the electrolytic solution, and the back side of the stainless steel plate was reinforced with a carbon steel plate 7B having a thickness of 16 mm.

Inlet 13 and outlet 14 of the press head 7 were in circular forms having a diameter shown in Table 1, and their positions were in conformity to the corresponding positions of the openings at the press head-facing side of the insulating plate. Flanged short tubes 7A made of a stainless steel sheet having a thickness of 0.5 mm were inserted into the inlet 13 and the outlet 14 of the press head, and weight loss of the flanged short tubes were measured as a galvanic corrosion loss. The flange section of the flanged short tube 7A had an outer diameter of 60 mm, and the short tube section had an inner diameter of 15 mm in Examples 2A–2C, and an inner diameter of 40 mm in Example 2D, while the length of the short tube was 50 mm in all of Examples 2A–2D.

As the material for a press head 8, a carbon steel plate having a thickness of 16 mm was used. A natural rubber plate 10A having a thickness of 3 mm without any hole was placed between the press head 8 and the electrode plate 3.

The aforementioned members were assembled as shown in FIG. 3, and then the press heads 7 and 8 at both ends were tightened by tightening bolts 24.

The available electrolytic area per electrode plate was 0.18 $dm^2$ and total available electrolytic area was 0.90 $dm^2$ in the present electrolytic cell.

The electrolysis apparatus had the same structure as shown in FIG. 2, except that the press head 7 having the inlet 13 and the outlet 14 was placed above the electrode plates.

Dimethyl ester of sebacic acid was synthesized from monomethyl ester of adipic acid by electrochemical reaction in the above-mentioned apparatus.

The electrolytic solution for the respective Examples was a methanol solution which contained, at the start of electrolysis, 36±1.0% by weight of monomethyl ester of adipic acid, 4.9±0.2% by weight of potassium salt of monomethyl ester of adipic acid, and 1.8±0.2% by weight of water, and 1,400 g of the electrolytic solution having the aforementioned composition was charged into the tank B and subjected to electrolysis for 7.25 hours while setting a flow velocity of the electrolytic solution between the electrode plates to 2.0 m/sec., a temperature of the electrolytic solution to 55° C., and a current density to 20 $A/dm^2$. In all the Examples, the foregoing operation was conducted three times, and then the electrolysis apparatus was dismantled to measure the change in weight of the flanged short tubes 7A. The value of the change in weight was divided by the value of total quantity of electric current used, whereby a galvanic corrosion loss per current is obtained. Results are shown in Table 1.

COMPARATIVE EXAMPLE 2

In Comparative Examples 2A and 2B, the same apparatus as in Example 2A was used, except that the insulating plate 5 having a different shape and a different dimension was used. In Comparative Example 2C, the same apparatus as used in Example 2A was used except that a natural rubber sheet having a thickness of 2.5 mm was used in place of the insulating plate 5 and no gasket 10 was used.

The insulating plate used in Comparative Examples 2A and 2B was made from polypropylene and had an outer dimension of 300 mm×80 mm and a thickness given in Table 2, and the inflow hole and outflow hole were bored in circular forms having a diameter of 50 mm at positions in conformity with the positions of the corresponding inflow hole and the outflow hole of the electrode plate 2.

In Comparative Example 2C, a natural rubber sheet having an outer dimension of 300 mm×80 mm and holes having the same dimension at the same positions as those of the electrode plate 2 was placed between the electrode plate 2 and the press head 7. These apparatuses were assembled in the same manner as in Example 2, and electrolysis was carried out with the same electrolytic solution under the same operating conditions as in Example 2, except that the operation was carried out only once in all the Comparative Examples. Galvanic corrosion loss per quantity of electric current, obtained in the same manner as in Example 2 is shown in Table 2.

It is obvious from comparison of Examples 2A and 2B with Comparative Example 2C that as the thickness of the insulating plate is increased the galvanic corrosion loss of the press head can be more suppressed.

However, it is obvious from comparison of Example 2A with Comparative Example 2A and comparison of Example 2B with Comparative Example 2B that, when the holes of the insulating plate is larger than the corresponding holes of the electrode plates and the press head, and the peripheral edges of the holes of the electrode plates directly face the peripheral edges of the holes of the press head, the galvanic corrosion of the press head is increased.

It is also obvious from comparison of Example 2B with Example 2C that even if the thickness of the insulating plates is equal to each other, the bent passages of the inflow hole and the outflow hole at the inside of the insulating plate to avoid aligned communication between the electrode plate and the press head are very effective for the suppression of galvanic corrosion of the press head.

In Example 2D wherein the peripheries of the holes of the electrode plates and the press head were prevented from inward protrusion from the peripheral edges of the holes of the insulating plate, a remarkable effect of preventing the galvanic corrosion was obtained even when the insulating plate was relatively thin.

TABLE 1

| Example No. | 2A | 2B | 2C | 2D |
|---|---|---|---|---|
| Insulating plate thickness (mm) | 40 | 10 | 10 | 4 |
| Insulating plate holes (mm) | 40 (diameter) | 40 (diameter) | 40 × 40 bent | 40 (diameter) |
| Inner diameter of flanged short tube 7A (mm) | 15 | 15 | 15 | 40 |
| Total current quantity (A . hr) | 77.4 | 78.6 | 79.6 | 76.5 |
| Weight change of flanged short tube 7A (mg) | less than −0.1 | −4.2 | −0.7 | less than −0.1 |
| Galvanic corrosion loss/current quantity (mg/A . hr) | less than 0.001 | 0.053 | 0.0088 | less than 0.001 |

TABLE 2

| Comp. Ex. No. | 2A | 2B | 2C |
|---|---|---|---|
| Insulating plate thickness (mm) | 40 | 10 | 25 |
| Insulating plate holes (mm) | 50 (diameter) | 50 (diameter) | 40 (diameter) |
| Inner diameter of flanged short tube 7A (mm) | 15 | 15 | 15 |
| Total current (A . hr) | 26.1 | 26.4 | 26.1 |
| Weight change of flange short tube 7A (mg) | −1.6 | −6.9 | −8.7 |
| Galvanic corrosion loss/current quantity (mg/A . hr) | 0.062 | 0.26 | 0.33 |

EXAMPLE 3

The same apparatus as in Example 2D was used except that the electrode plates 1 and 2 were platinum plated in an area at the distance between the inflow hole 11 and the outflow hole 12 excluding 3 mm-long parts from the inside edges of the holes, that is, the distance of 174 mm and a width of 10 mm only at one side thereof, and the side walls of the holes were not plated. An available electrolytic area per electrode plate was 0.174 $dm^2$ and total available electrolytic area was 0.87 $dm^2$. 1,400 g of an electrolytic solution having the same composition as in Example 2 was prepared and subjected to electrolysis for 6.5 hours under the same operating conditions as in Example 2. The change in weight of the flanged short tubes 7A was less than −0.1 mg. After the end of electrolysis, the current efficiency of dimethyl ester of sebacic acid obtained from the yield thereof was 59.2%.

On the other hand, the current efficiency of dimethyl ester of sebacic acid in Example 2D, likewise obtained, was 51.1%.

What is claimed is:

1. A filter press-type electrolytic cell comprising parallel electrode plates with inflow holes and outflow holes for allowing an electrolytic solution to be passed, gaskets being placed between the electrode plates to seal their peripheral edges, spacers being put on one side of the electrode plates to keep a given distance therebetween, and a pair of metallic press heads being provided at the both ends of the group of the electrode plates to tighten them, wherein supply and discharge of the electrolytic solution to and from spaces between the electrode plates is conducted through inflow holes and outflow holes of the individual electrode plates, wherein an improvement comprises one or more inlets and one or more outlets for the electrolytic solution being provided on only one of the press heads and communicated with the inflow holes and the outflow holes of the individual electrode plates, respectively, and an insulating plate of non-electroconductive material having a thickness of 4–60 mm being placed between the press head with the inlet and the outlet and the nearest electrode plate thereto, the insulating plate having inflow holes and outflow holes which communicate with the inflow holes and the outflow holes of the individual electrode plates, respectively, and the edge parts of the holes of adjacent electrode plate and the adjacent press head are prevented from inwardly protruding from the edge of holes of the insulating plate in a state of stacking the insulating plate and the adjacent electrode plate and the adjacent press head one upon another in positions at normal operation.

2. A filter press-type electrolytic cell according to claim 1, wherein the insulating plate has a thickness of 10–40 mm.

3. A filter press-type electrolytic cell comprising parallel electrode plates with inflow holes and outflow holes for allowing an electrolytic solution to be passed, gaskets being placed between the electrode plates to seal their peripheral edges, spacers being put on one side of the electrode plates to keep a given distance therebetween, and a pair of metallic press heads being provided at the both ends of the group of the electrode plates to tighten them, wherein supply and discharge of the electrolytic solution to and from spaces between the electrode plates is conducted through inflow holes and outflow holes of the individual electrode plates, wherein an improvement comprises one or more inlets and one or more outlets for the electrolytic solution being provided on only one of the press heads and communicated with the inflow holes and the outflow holes of the individual electrode plates, respectively, an insulating plate of non-electroconductive material being placed between the press head with the inlet and the outlet and the nearest electrode plate thereto, the insulating plate having inflow holes and outflow holes which communicate with the inflow holes and the outflow holes of the individual electrode plates, respectively, and the inflow hole and the outflow hole of the insulating plate are bent at the inside of the insulating plate, and openings of the insulating plate at the electrode plate side are out of alignment to openings of the insulating plate at the press head side.

4. A filter press-type electrolytic cell according to any one of claims 1 or 3 wherein the inlet and the outlet for the electrolytic solution are provided on a stationary press head.

5. A filter press-type electrolytic cell according to any one of claims 1 or 3 wherein the electrode plates and the insulating plate are in substantially rectangular forms; at least one inflow hole and at least one outflow hole are bored on the individual electrode plates at positions near peripheral edge parts of the parallel side of the rectangular form to a substantially full length of the sides; corresponding number of the inflow hole and the outflow hole are bored on the insulating plate at positions corresponding to those of the inflow hole and the outflow hole of the individual electrode plates; and corresponding number of the inflow hole and the outflow hole are bored on the press head having the inlet and the outlet for electrolytic solution at the insulating plate-facing side at positions corresponding to those of the inflow hole and the outflow hole of the insulating plate, and an inflow chamber connected to the inlet and all the inflow holes of the press head and an outflow chamber connected to the outlet and all the outflow holes of the press head at the inside of the press head.

6. A filter press-type electrolytic cell according to any one of claims 1 or 3 wherein the insulating plate is made from natural rubber, synthetic rubber, polyolefin, polyamide, or polyester or those further containing an inorganic filler.

7. A filter press-type electrolytic cell according to any one of claims 1 or 3 wherein the inflow hole and the outflow hole are bored at geometrically equal position in equal shape with equal dimension on the individual electrode plates.

8. A filter press-type electrolytic cell according to any one of claims 1 or 3 wherein the group of the electrode plates are placed horizontally and the press heads are provided at both ends of the group of the electrode plates.

9. A filter press-type electrolytic cell according to any one of claims 1 or 3 wherein the electrode plates are double electrode plates having a thickness of 1.5–5 mm.

10. A filter press-type electrolytic cell according to claim 9, wherein other electrode plates than the electrode plate having the lowest potential are made from titanium or tantalum, at least one side of which is coated with platinum, rhodium, ruthenium or iridium alone or in their alloy in a substantially entire surface range.

11. A filter press-type electrolytic cell according to claim 10, wherein peripheral edge parts of the inflow hole and the outflow hole of the electrode plate are free from the coating of the coating metal.

* * * * *